US005876320A

United States Patent [19]

LeCompte

[11] Patent Number: 5,876,320

[45] Date of Patent: Mar. 2, 1999

[54] UNIVERSAL HALF FOLDER APPARATUS

[75] Inventor: Robert S. LeCompte, Tucson, Ariz.

[73] Assignee: Bell & Howell Cope Company, Durham, N.C.

[21] Appl. No.: 691,208

[22] Filed: Aug. 1, 1996

[51] Int. Cl.[6] ..... B42C 1/00

[52] U.S. Cl. ..... 493/125; 493/451; 493/395

[58] Field of Search ..... 493/125, 127, 493/142, 147, 162, 243, 246, 395, 398, 399, 400, 401, 405, 408, 410, 416, 417, 422, 423, 436, 437, 441, 442, 451

[56] References Cited

U.S. PATENT DOCUMENTS 2,815,946 12/1957 Cran .
2,861,801 11/1958 Cran .
3,285,144 11/1966 Frei ..... 493/436
3,517,919 6/1970 Flygare .
4,875,668 10/1989 Spyra .
5,251,425 10/1993 Kern .

*Primary Examiner*—Joseph J. Hail, III
*Assistant Examiner*—Anthony Ojini
*Attorney, Agent, or Firm*—Patula & Associates

[57] ABSTRACT

A continuous sheet folder apparatus is disclosed that can fold any size paper in half with nested inserts inside the paper. The apparatus can also function in an intermittent mode. The half folding apparatus is accomplished by a set of lifting fingers and stationary fingers which interact to curl the sheet leading edge upwards and over until it registers with the trailing edge, passing beneath it. The sheet is then creased in a presser unit. The lifting fingers are spring mounted and biased toward the oncoming sheet.

16 Claims, 16 Drawing Sheets

UNIVERSAL HALF FOLDER APPARATUS

The present invention relates to an apparatus for folding sheet material in half and in particular to a continuous motion transport of universal size sheet material and specifically to a high speed universal sheet folder and presser, with or without inserts, for automated mailing systems.

BACKGROUND OF THE INVENTION

There is a need especially in automated mailing systems to fold sheet stock in half with the side benefit that other materials can be inserted within the folded sheet. Prior art sheet folding machines are very complicated and expensive and are extremely large machines that are only capable of folding a certain size sheet. Such prior art machines teach the general concepts of continuous sheet feeding as well as lifting the sheet leading edge and holding it until the trailing edge is conveyed beneath it. However, these prior art devices are not readily adaptable to various sheet widths. Additionally these known devices utilize actuators which rely on outside energy sources to lift and grip the sheet lead end.

For example, U.S. Pat. No. 3,517,919 to Flygare discloses a sheet folding machine that incorporates a lead edge lifting device incorporating lift fingers which are actuated with pneumatic pistons and which grab the sheet lead edge upwards to be pinched between gripping elements. The lifting device of Flygare relies upon a complex system of switches and valves to insure that the lead edge of the sheet is gripped and released at a proper time. Flygare contains no teaching or suggestion regarding the ability to nest inserts for the sheet and Flygare describes a second folding operation which would prevent the inclusion of such inserts.

U.S. Pat. No. 2,861,801 to Cran discloses a lead edge lifting device used for a laundry folder. Three switch elements monitor the advance of the lead edge and a movable gripping member is actuated to intercept the oncoming lead edge. The lead edge is gripped between the movable grip and a fixed grip until the proper time passes to accomplish folding the sheet in half. Another patent to Cran U.S. Pat. No. 2,815,946 is concerned with a safety catch mechanism which is employed to insure that the movable grip does not accidentally drop onto the conveyor until the sheet trailing edge has passed under it.

U.S. Pat. No. 4,875,668 issued to Spyra and assigned to the assignee of the instant application, discloses high speed sheet folder and presser for automated mailing systems. U.S. Pat. No. 4,875,668 issued to Spyra is herein incorporated by reference. Spyra incorporates a set of software controlled rods that roll the lead edge of the paper up and back over the trailing half of the paper, thus enabling the machine to run continuously and providing the capability of folding any length of paper. However the apparatus of Spyra is unable to handle paper of universal width without breaking the transport, thus adding to the cost and complexity of the machine.

Accordingly, there is a need for a continuous sheet folder that can fold any size sheet (length and width) in half, with or without nested inserts inside the folded sheet. The present invention fulfills this need and overcomes the disadvantages of prior art folding machines.

BRIEF SUMMARY OF THE INVENTION

The present invention consists of a continuous sheet folder apparatus that can fold any size paper in half with the capability of nesting inserts inside the folded paper. The present invention can also function in an intermittent mode. The half folding is accomplished by a set of lifting fingers and stationary fingers which interact to curl the sheet lead edge upward and over until it registers with the trailing edge passing beneath it. The sheet is then creased in a presser unit. The lifting fingers are spring mounted and biased toward the oncoming sheet and are actuated by the advancing sheet.

It is the principal object of the present invention to provide a continuous sheet folder that can fold any size paper in half with nested inserts inside the paper.

It is a further object of the invention to provide a half folder apparatus that is reduced in size and cost to produce.

It is another object of the invention to provide a sheet folder apparatus that is easier to assemble and maintain.

It is also an object of the present invention to provide a half folder apparatus that is easy to assemble, having a reduced part count, and provides for ease of jam removal.

It is an additional object of the present invention to teach a universal half folding apparatus that is capable of selectively folding sheet stock on a continuous or Intermittent modes and capable of being controlled by software if desired.

Numerous other advantages and features of the invention will become really apparent from the detailed description of the preferred embodiment of the invention from the claims and from the accompanying drawings in which like numerals are employed to designate like parts throughout the same.

BRIEF DESCRIPTION OF THE DRAWINGS

A fuller understanding of the foregoing may be had by reference to the accompanying drawings wherein.

DETAILED DESCRIPTION OF THE PREFERRED EMBODIMENT OF THE PRESENT INVENTION

Figure 1:
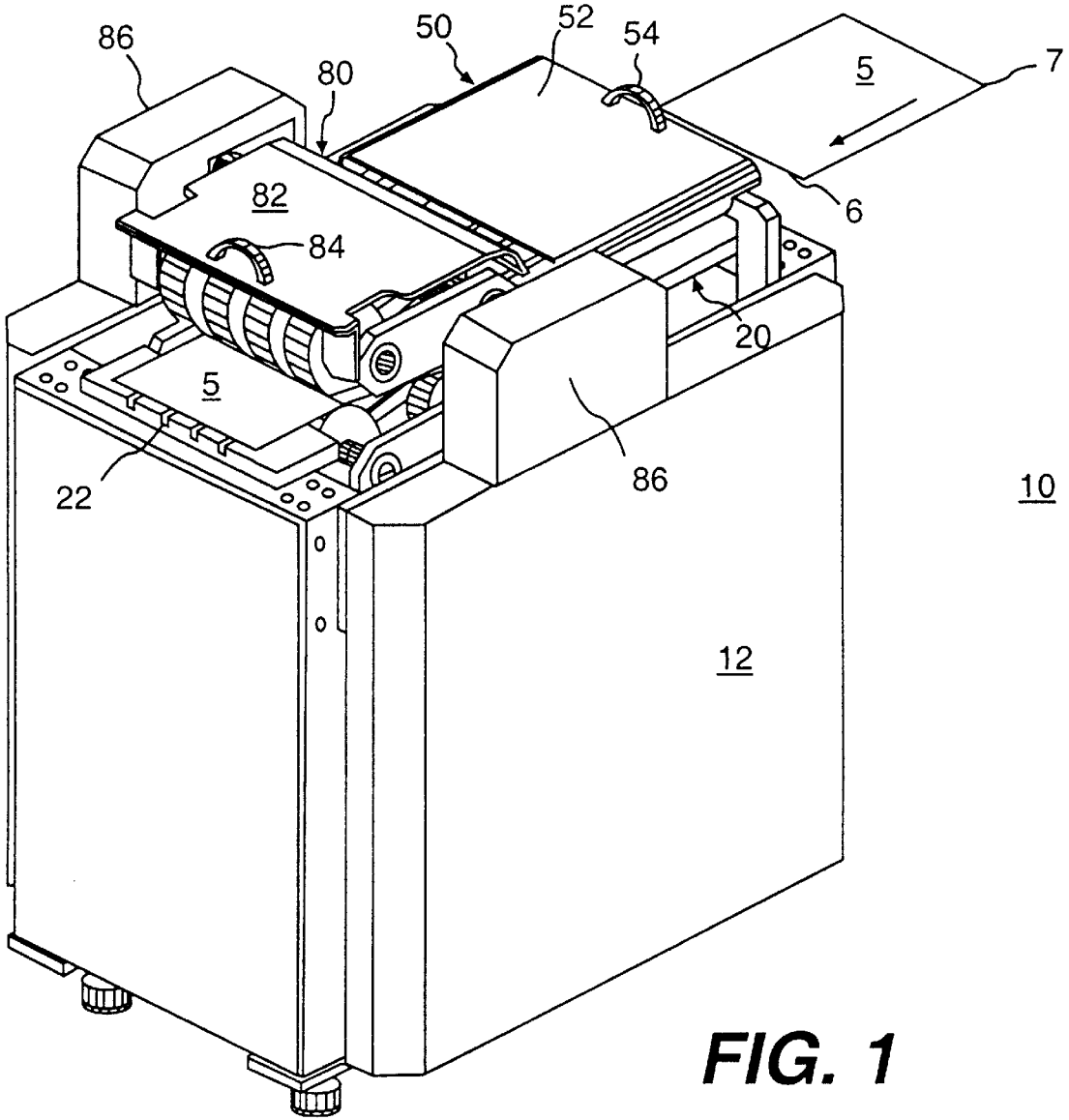
FIG. 1 is a prospective view of the preferred embodiment of the present invention.

While the invention is suspectable of embodiment in many different forms there is shown in the drawings and will be described herein in detail a preferred embodiment of the invention. It should be understood however that the present disclosure is to be considered an exemplification of the principals of the invention and is not intended to limit the spirit and scope of the invention and/or claims of the embodiment illustrated.

FIG. 1 illustrates the present invention 10 having housing 12. Invention 10 receives a sheet or document 5 to be folded. Document 5 includes a leading edge 6 and a trailing edge 7. The document to be folded enters a half folding mechanism 50 having a cover 52 with a handle 54. The document 5 moves along a transport 20 having a plurality of slots 22 therein, as will be described in more detail later. Half folding mechanism 50 folds the document 5 in half and passes it along the transport to the pressing unit 80 having a cover 82 and a handle 84. Pressing unit 80 is mounted between gear boxes 86. Once folded and pressed, the document 5 exits the back end of the machine for processing by a user.

Figure 2:
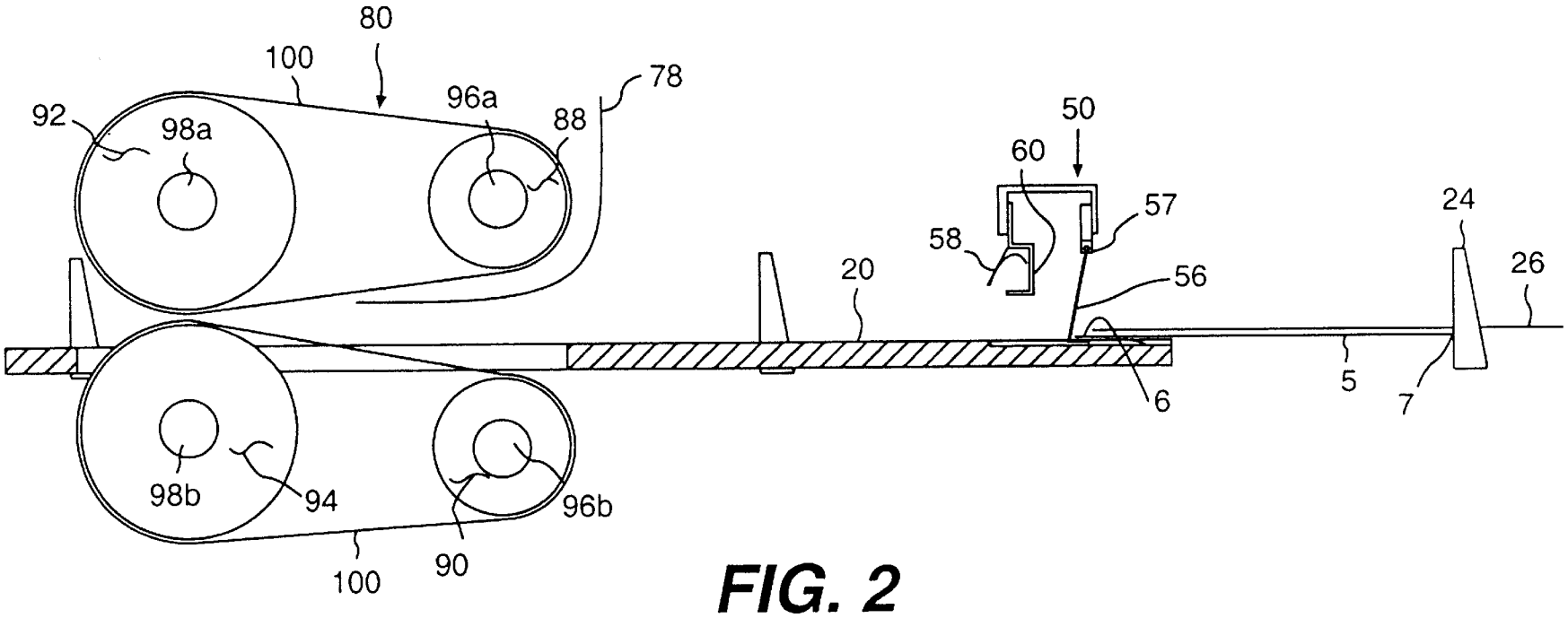
FIG. 2 is a schematic side view of the present invention.

FIG. 2 illustrates schematically the components of the present invention 10 having a transport 20. A plurality of pusher elements 24 slide in slots 22 of transport 20 and propel the document 5 resting on the top surface of the transport 20 through the invention 10. Document 5 passes under an upper constraint 26 and first reaches the half fold mechanism 50 which comprises lift fingers 56 spring biased by torsion springs 57, and stationary fingers 58. As the pushers propel the paper along, the lifting mechanism causes the paper to be folded in half at which time the pusher elements 24 push the half folded paper underneath leader guide 78 and into the pressing unit 80. Pressing unit 80 comprises a plurality of rollers 88, 90, 92, 94. Rollers 88 are mounted on drive shaft 96*a*. Rollers 90 are mounted on drive shaft 96*b*. Rollers 92 are mounted on an idler shaft 98*a* and rollers 94 are mounted on an idler shaft 98*b*. Rollers 88 and 92 which comprise the top presser unit element are connected by way of tapered belts 100. Similarly, rollers 90 and 94 which comprise the lower presser unit element are connected via tapered belts 100.

Figure 3:
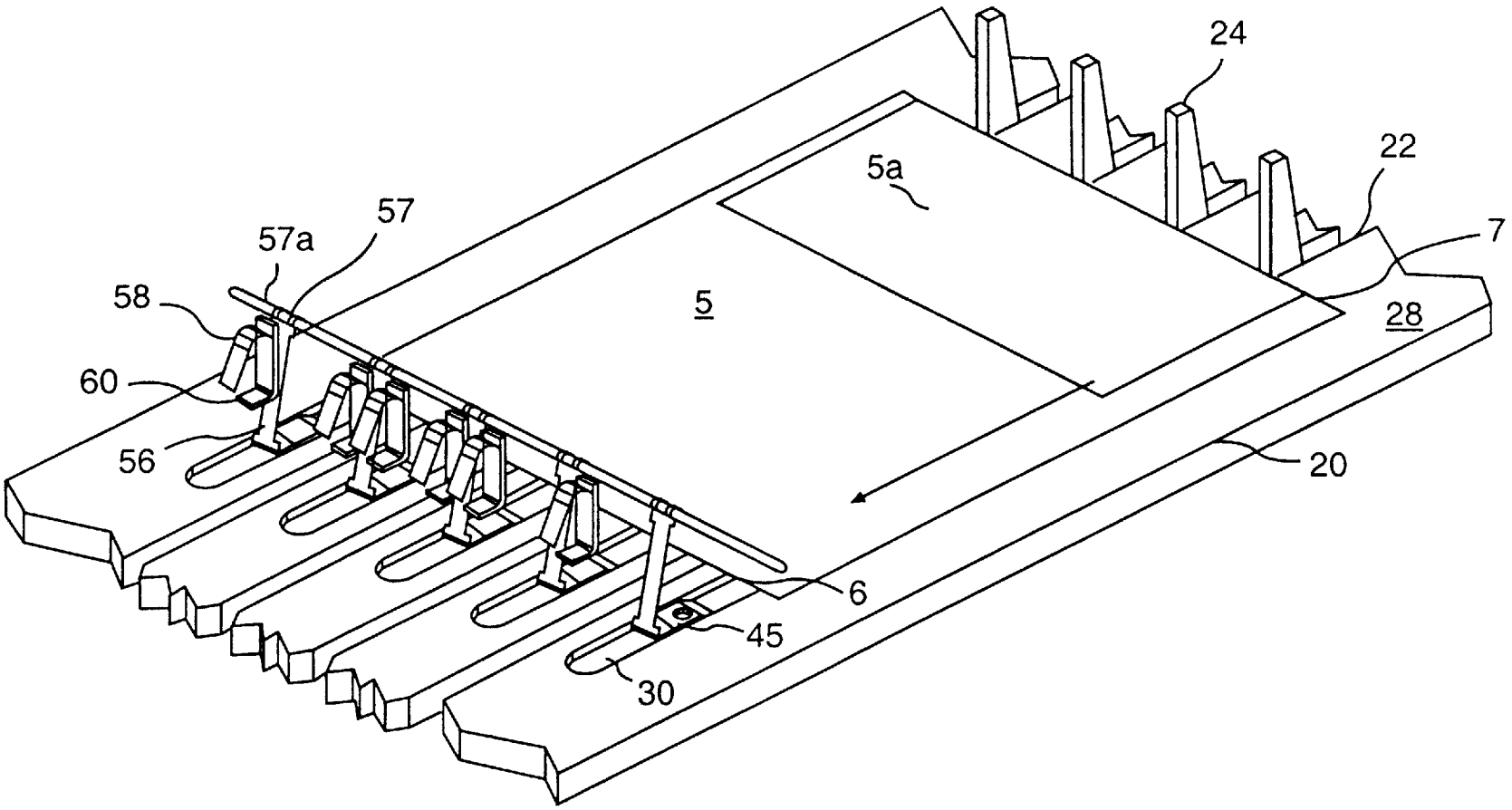
FIG. 3 is a perspective view of the transport and half folding mechanism of the present invention.

FIG. 3 shows a top perspective view of the document 5 with lead edge 6 and trail edge 7 resting on the top surface 28 of transport 20. An insert 5*a* is shown resting on top of document 5. Transport 20 includes a plurality of slots 22 in which a plurality of pushers 24 slide therein. Pushers 24 are illustrated as a plurality of chain driven picks. Preferably however the pusher elements could be any suitable means for pushing the document through the invention 10. As further can be seen, top surface 28 of transport 20 includes recessed portions 30 containing lift finger stops 45 therein at which the bottom edge of the lift fingers 56 of the half fold mechanism 50 rest there against via the bias of torsion springs 57. Lift fingers 56 are mounted via the torsion springs 57 to a mounting pin 57*a* in any suitable manner. Mounted next to each lift finger in any suitable manner are the stationary FIGS. 58 of the half fold mechanism 50. Stationary fingers 58 include a stripper portion 60.

Figure 4:
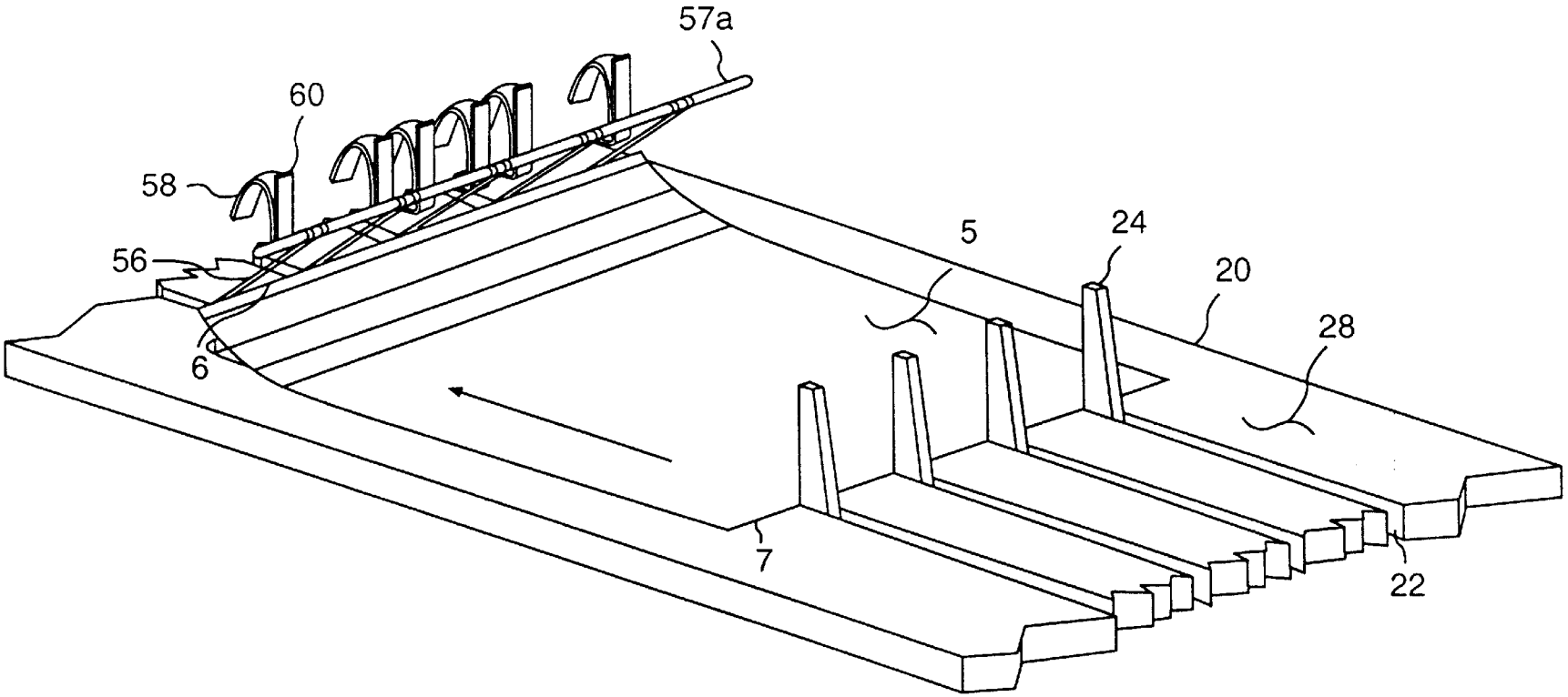
FIG. 4 is a perspective view of the transport and half folding mechanism engaging a piece of paper.

FIG. 4 illustrates the leading edge 6 of document 5 being pushed by pushers 24 in slots 22 of transport 20 and engaging the lift fingers 56 at which time continued movement of the document 5 forward causes the lift fingers to lift the leading edge of the paper upwards towards stationary fingers 58. Should any inserts have been placed upon document 5 such inserts would contact stripper portions 60 of stationary fingers 58 and thereby being prevented from being lifted. (See FIG. 7A)

Figure 5:
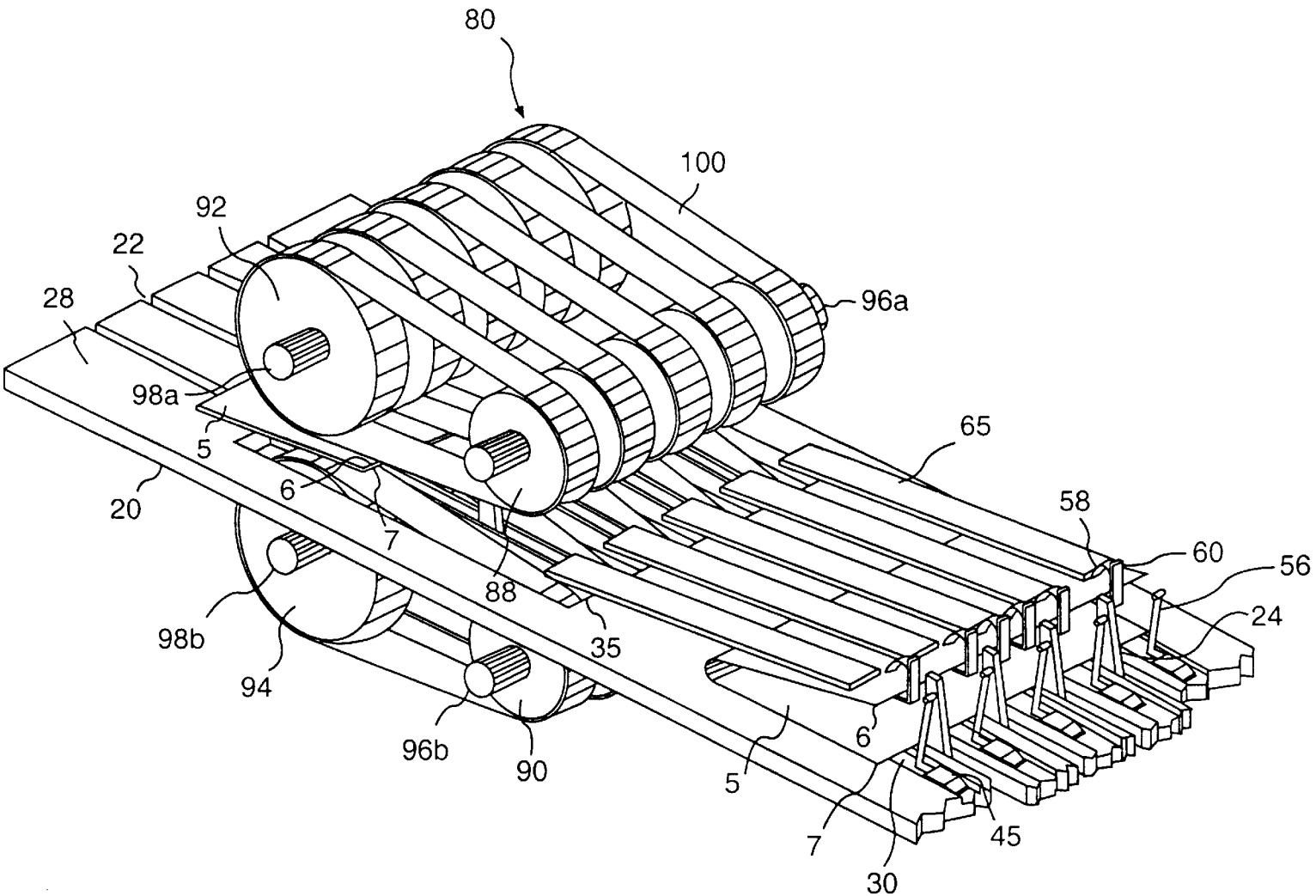
FIG. 5 is a perspective view of the half folding mechanism and the pressing unit of the present invention.

As can be seen in FIG. 5, continued movement of the document forward causes lifting fingers 56 to carry the leading edge 6 into the hook of stationary fingers 58 and thereupon hold therein. (See FIG. 8) Continued movement of the pushers 24 forward causes the trailing edge 7 to align with the leading edge 6 at which point the pushers 24 begin to push both the leading edge 6 and the trailing edge 7 at the same time. The lift fingers 56 then return down against stops 45 to await the next document. The document 5 then proceeds under retaining strips 65 of leader guide 78 and towards the pressing unit 80. Upon passing through pressing unit 80 the document becomes pressed and completely folded and is ready to be processed by the user.

Figure 6:
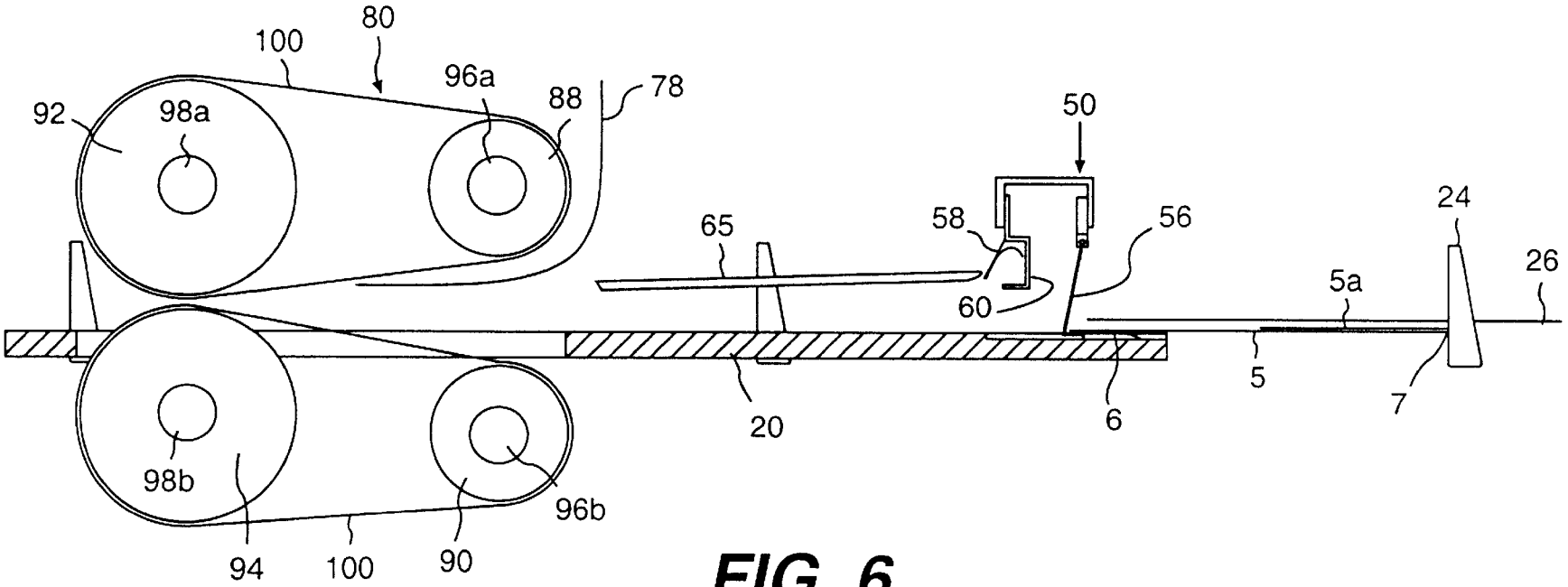
FIG. 6 is a schematic side view of the present invention at the start of folding operation.

FIGS. 6 through 11 illustrate in detail the exact movement of the document 5 through the invention 10. As can be seen in FIG. 6 pusher 24 pushes document 5 along transport 20 under the upper constraint 26 towards the half fold mechanism 50 comprising lifting fingers 56, stationary fingers 58 and stripper elements 60.

Figure 7:
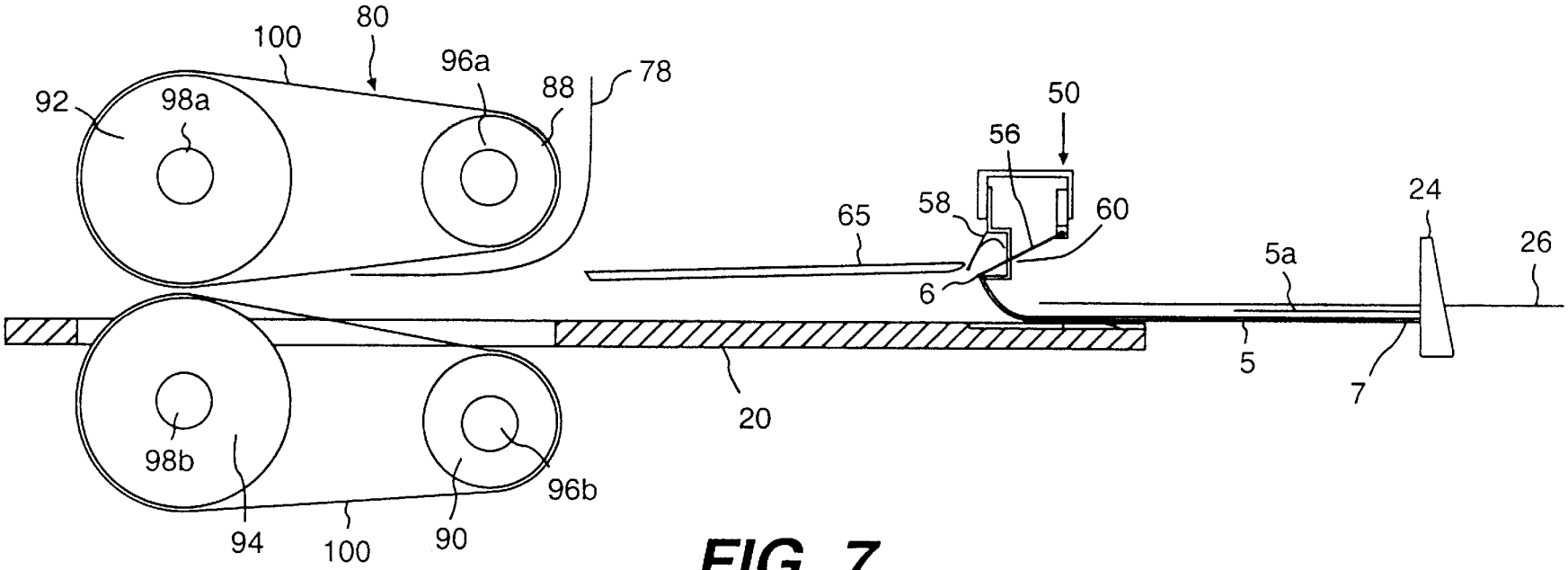
FIG. 7 is a schematic side view of the initial engagement of the sheet by the half folding mechanism.
Figure 7A:
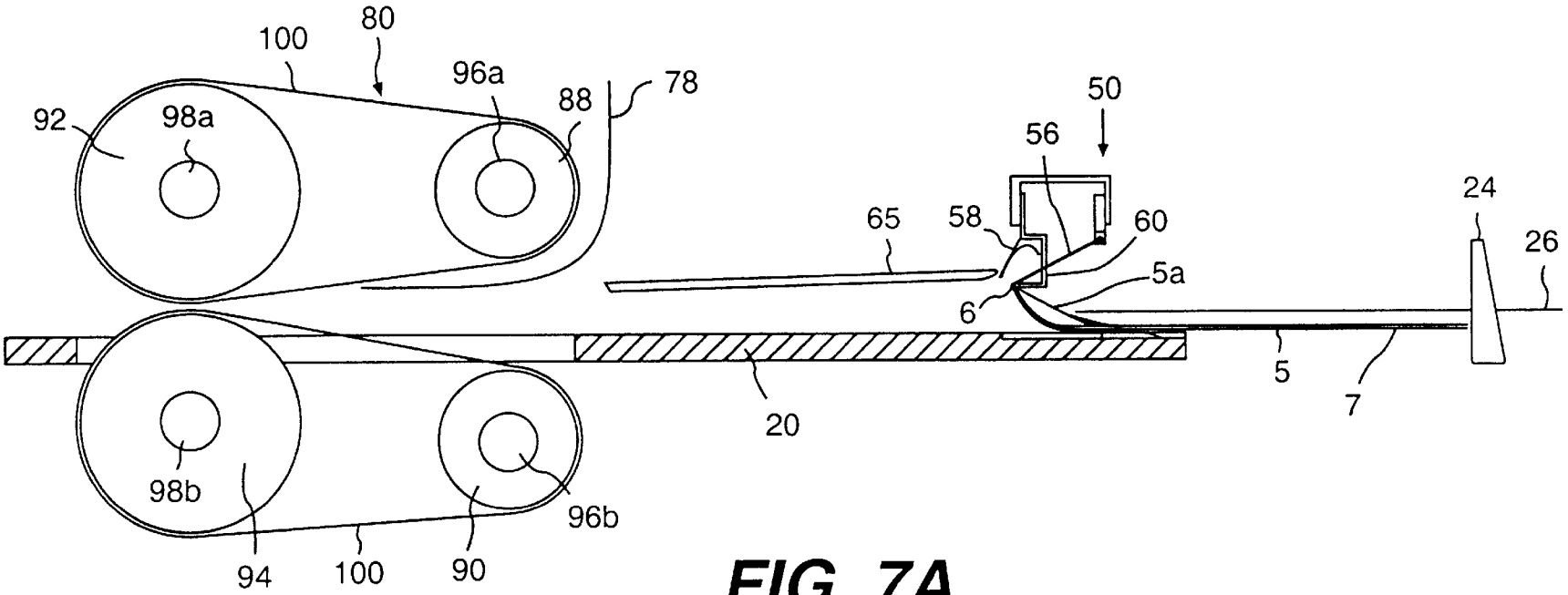
FIG. 7*a* is a schematic side view of engagement of inserts by the stripper elements of the present invention.

FIG. 7 illustrates the leading edge 6 engaging the lift fingers 56 and being lifted towards stationary fingers 58. FIG. 7*a* illustrates inserts 5*a*, having been placed on sheet 5 in any suitable manner, and being restricted by strippers 60. In the event inserts 5*a* are not deposited or positioned at the preferred trailing edge 7 of the sheet 5 when it enters the folding area 50, strippers 60 restrict further forward movement of the inserts 5*a* which are then drop back onto sheet 5 and awaits the approaching picks 24 (as show in FIG. 8*a*). Thus, sheet 5 can be folded in half around inserts 5*a*.

Figure 8:
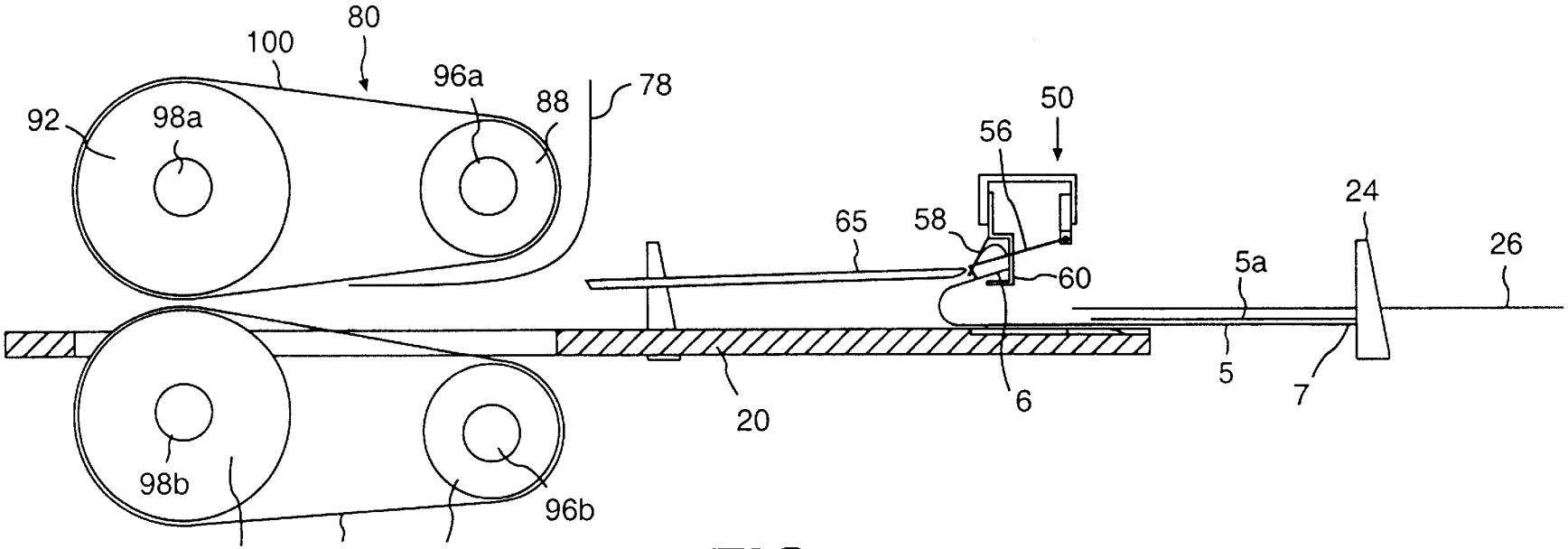
FIG. 8 is a schematic side view of the half folding mechanism beginning to fold the sheet.
Figure 8A:
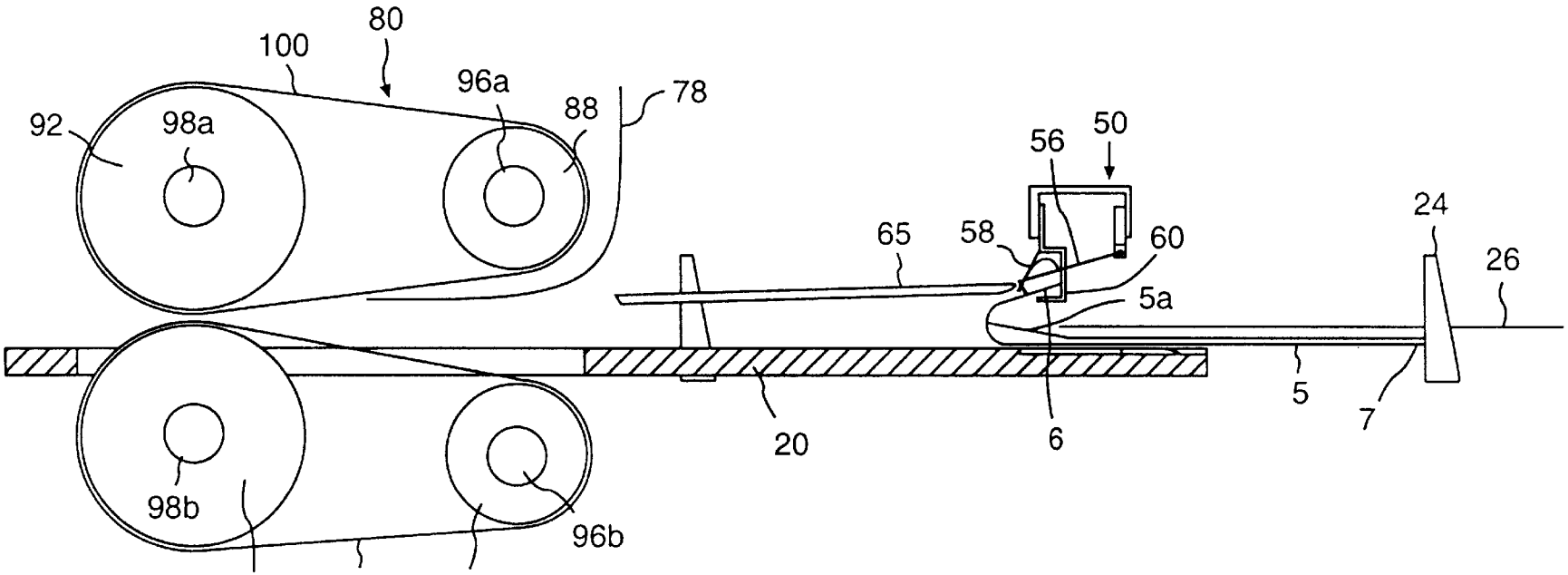
FIG. 8*a* is a schematic side view of the inserts of FIG. 7*a* having been forced back onto the sheet by the stripper elements of the present invention.
Figure 9:
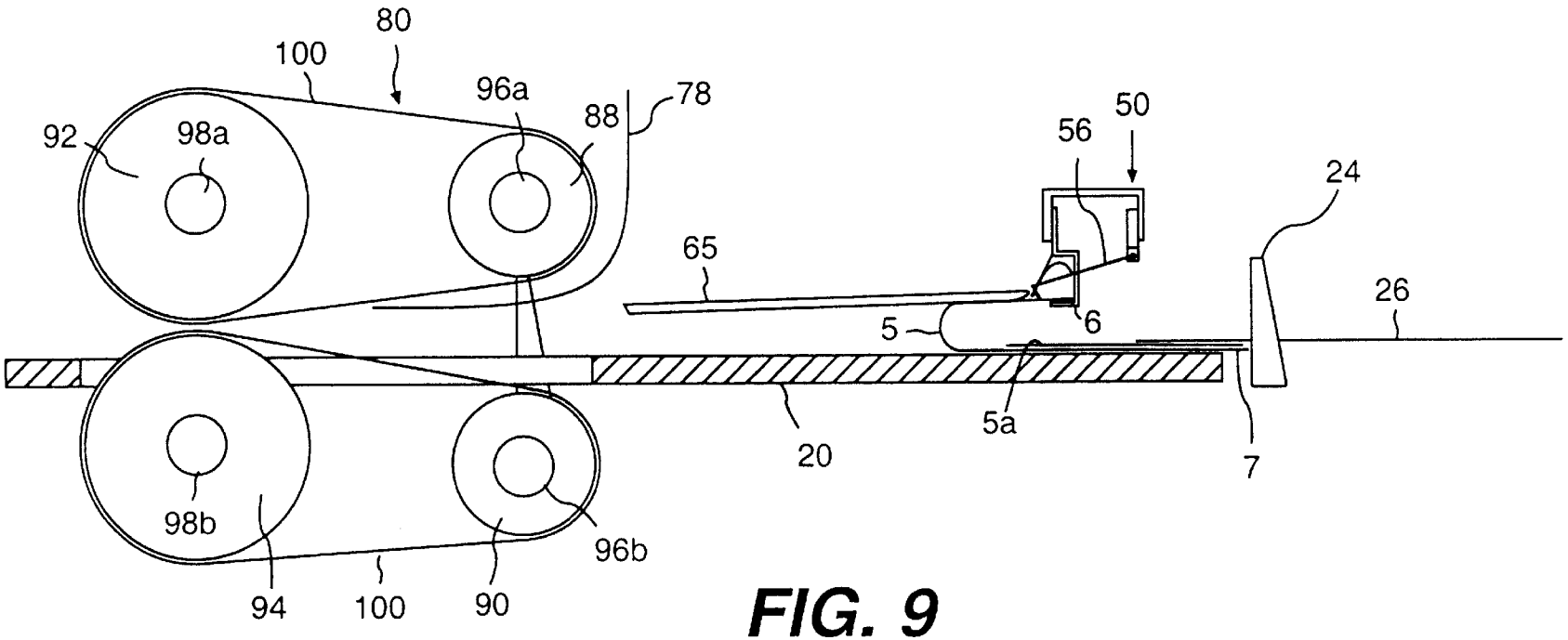
FIG. 9 is a side schematic diagram of the sheet being continued to be folded.

FIG. 8 illustrates the continued movement of document 5 through invention 10 whereupon lift fingers 56 cause the leading edge 6 of document 5 to curl over upon contact with stationary fingers 58 and onto the hook portion of stripper 60. FIG. 8A shows the insert 5*a* having been stripped and document 5 being folded around insert 5*a*. FIG. 9 shows document 5 being propelled further whereupon trailing edge 7 begins to approach leading edge 6 being held by lift fingers 56, stationary fingers 58 and strippers 60. The document 5 begins to enter presser unit 80 and is constrained by retaining strips 65 and then leader guide 78.

Figure 10:
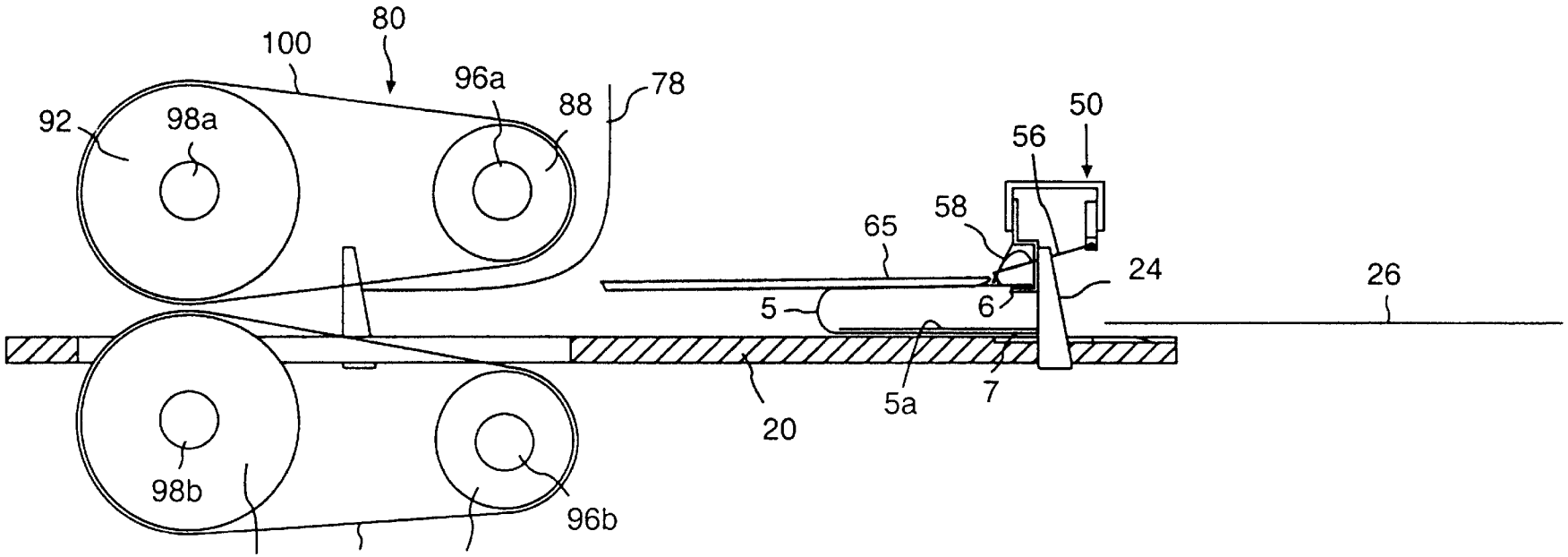
FIG. 10 is a schematic view of the completion of the folding by the half folding mechanism.
Figure 11:
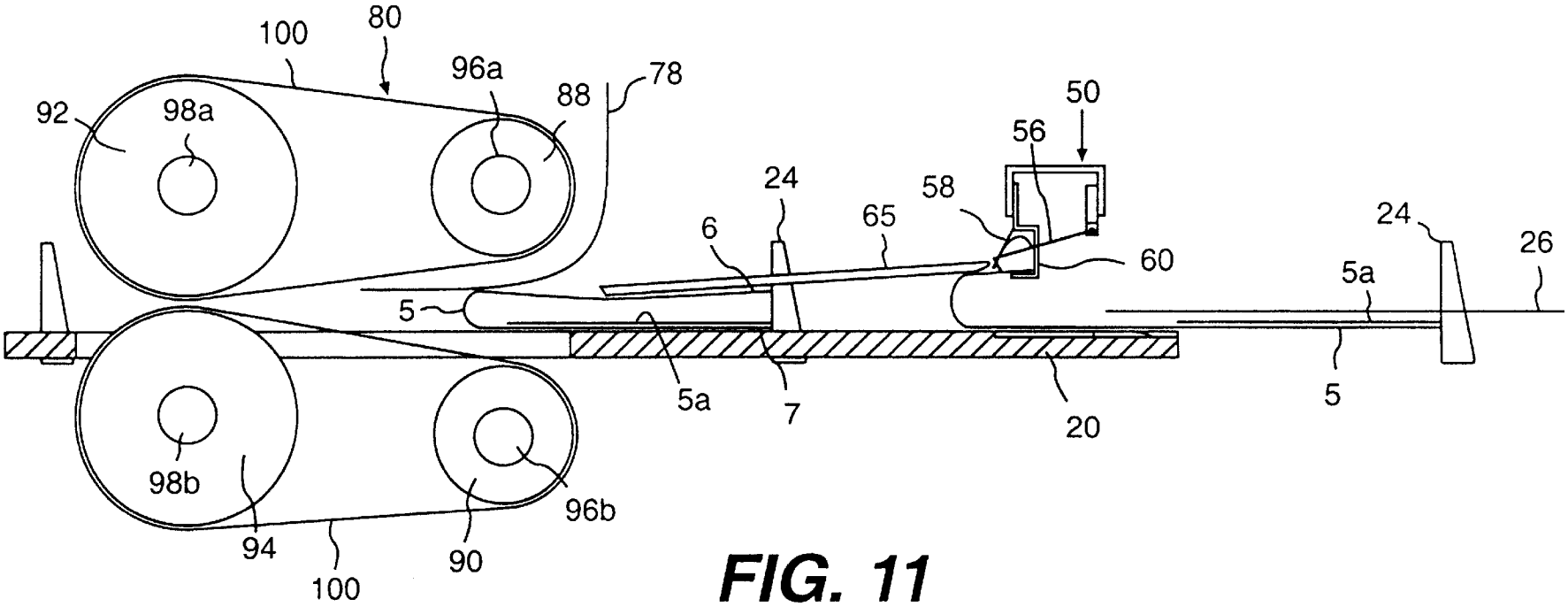
FIG. 11 is a schematic side view of the folded sheet entering the pressing unit.

FIG. 10 shows the leading edge 6 of document 5 being aligned with the trailing edge 7 of document 5 whereupon pusher 24 begins to move the half folded document under retaining strips 65, and leader guide 78 and into the pressing unit 80. FIG. 11 shows the leading edge 6 of document 5 having been pushed off of the stripper 60 and stationary fingers 58 and on top of the trailing edge 7 as the document begins to enter the pressing unit 80. The lift fingers 56 via the bias of torsion spring 57 are biased back down against the finger stop 45 in notch 30 to await receival of the leading edge 6 of the next document 5 in sequence as illustrated.

Figure 12G:
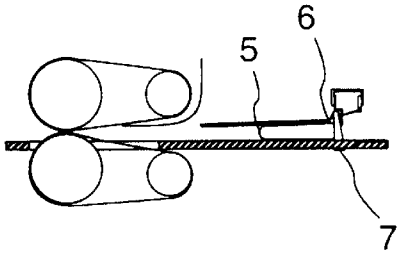
FIGS. 12*a* through 12*i* are schematic views of the complete folding process of the present invention.
Figure 12D:
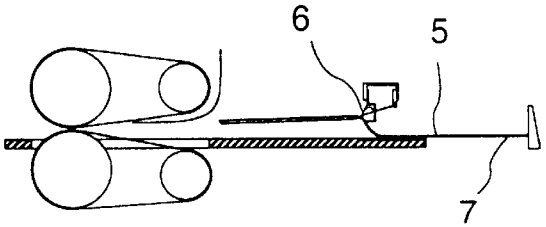
Figure 12A:
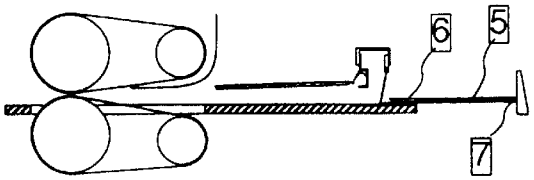
Figure 12H:
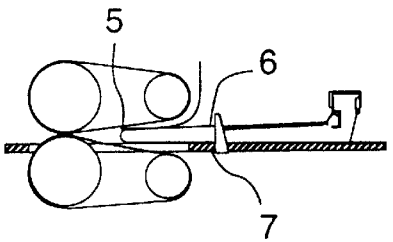
Figure 12E:
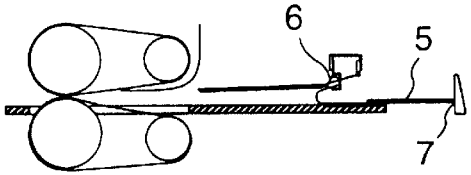
Figure 12B:
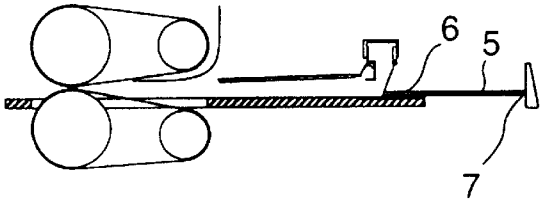
Figure 12I:
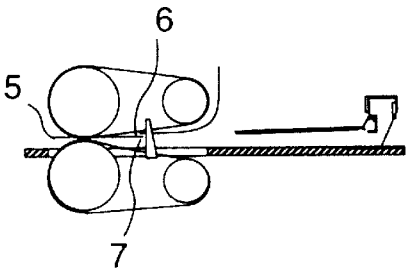
Figure 12F:
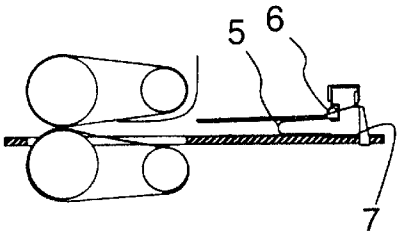
Figure 12C:
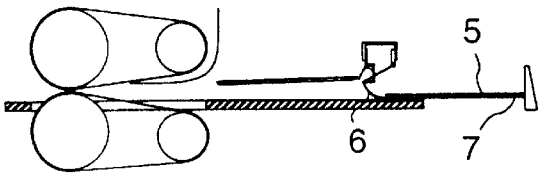

FIGS. 12*a* through 12*i* illustrates the universal half folding of a single document 5. FIG. 12*a* shows the document 5 at the initial stages prior to contacting lift fingers. FIG. 12*b* shows the leading edge 6 of document 5 contacting lift finger. FIG. 12*c* shows the leading edge 6 of document 5 being lifted by the lift finger to the stationary finger. FIG. 12*d* shows the leading edge 6 of the document 5 being passed from the lift finger to the stationary finger. FIG. 12*e* shows the continued movement of trailing edge 7 forward towards the leading edge 6 to half fold the paper 5. FIG. 12*f* shows trailing edge 7 being aligned with leading edge 6 as the document 5 begins to be passed under the remaining strips 65. FIG. 12*g* shows trailing edge 6 being completely aligned with leading edge 6 as document 5 is folded in half and is moved toward the pressing unit 80 for pressing. FIG. 12*h* shows the half folded document 5 being passed into the pressing unit 80. FIG. 12*i* shows the document 5 being pressed by the pressing unit 80.

Figure 13:
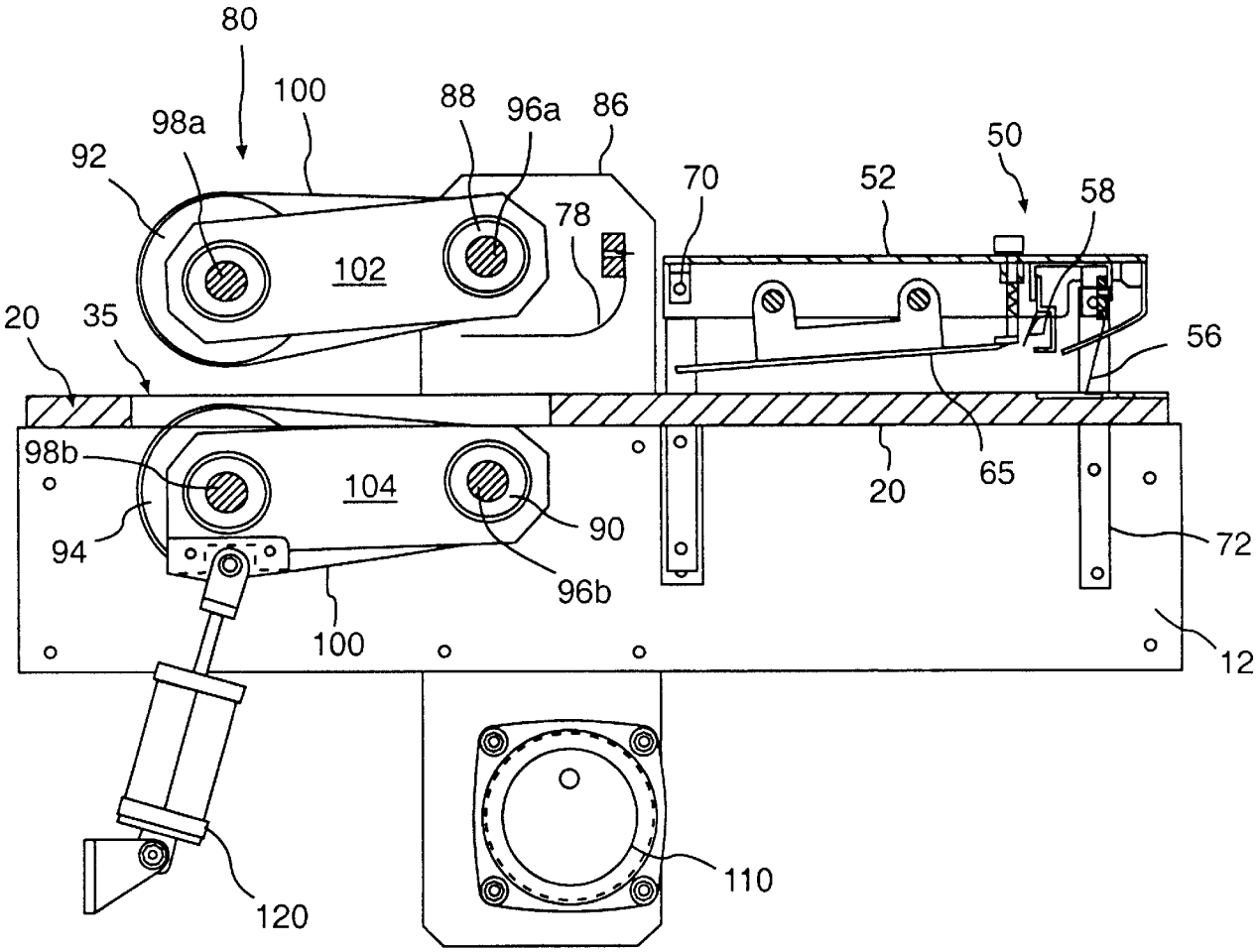
FIG. 13 is partial side view of the present invention.

FIG. 13 shows a side view of the invention 10 mounted to housing 12. Half folding mechanism 50 is suitably mounted above transport 20 in housing 12. As can be seen lift fingers 56 and stationary fingers 58 are suitably mounted to the frame of the cover 52 of the half fold mechanism 50. The frame or cover 52 of the half folded mechanism is pivotably mounted at hinge pivot 70 such that the entire half fold mechanism 50 may be easily lifted via handle 34 about pivot 70 up and away from the transport 20 so that any document jams can be removed or maintenance performed to the half folded mechanism 50. Additionally, the half folded mechanism 50 is provided with a latching mechanism 72 which latches the half folded mechanism 50 into the place during use and prevents half fold mechanism 50 from being pivoted unintentionally about pivot hinge 70.

Similarly, the pressing unit 80 can be seen mounted in housing 12 wherein the upper pressing unit portion comprising rollers 88 and 92 which are suitably fastened via upper shaft mount arm 102. Similarly the rollers 90 and 94 of the lower pressing unit portion are suitably mounted in housing 12 below and in the notches 35 of transport 20 and are suitably fastened via lower shaft mount arm 104. Drive shafts 96*a* and 96*b* are driven through gears 86*a* (FIG. 14) in gear box 86 via a motor 110. Lower pressing unit portion mounted by lower shaft mount arm 104 is adjustably positionable about drive shaft 96*b* via an air cylinder 120. Upper pressing portion unit mounted by upper shaft mount arm 102 is likewise pivotably mounted about drive shaft 96*a*. Thus a user is able to lift the upper pressing portion via handle 84 in order to remove any document jams or to perform maintenance to the pressing unit 80.

Figure 14:
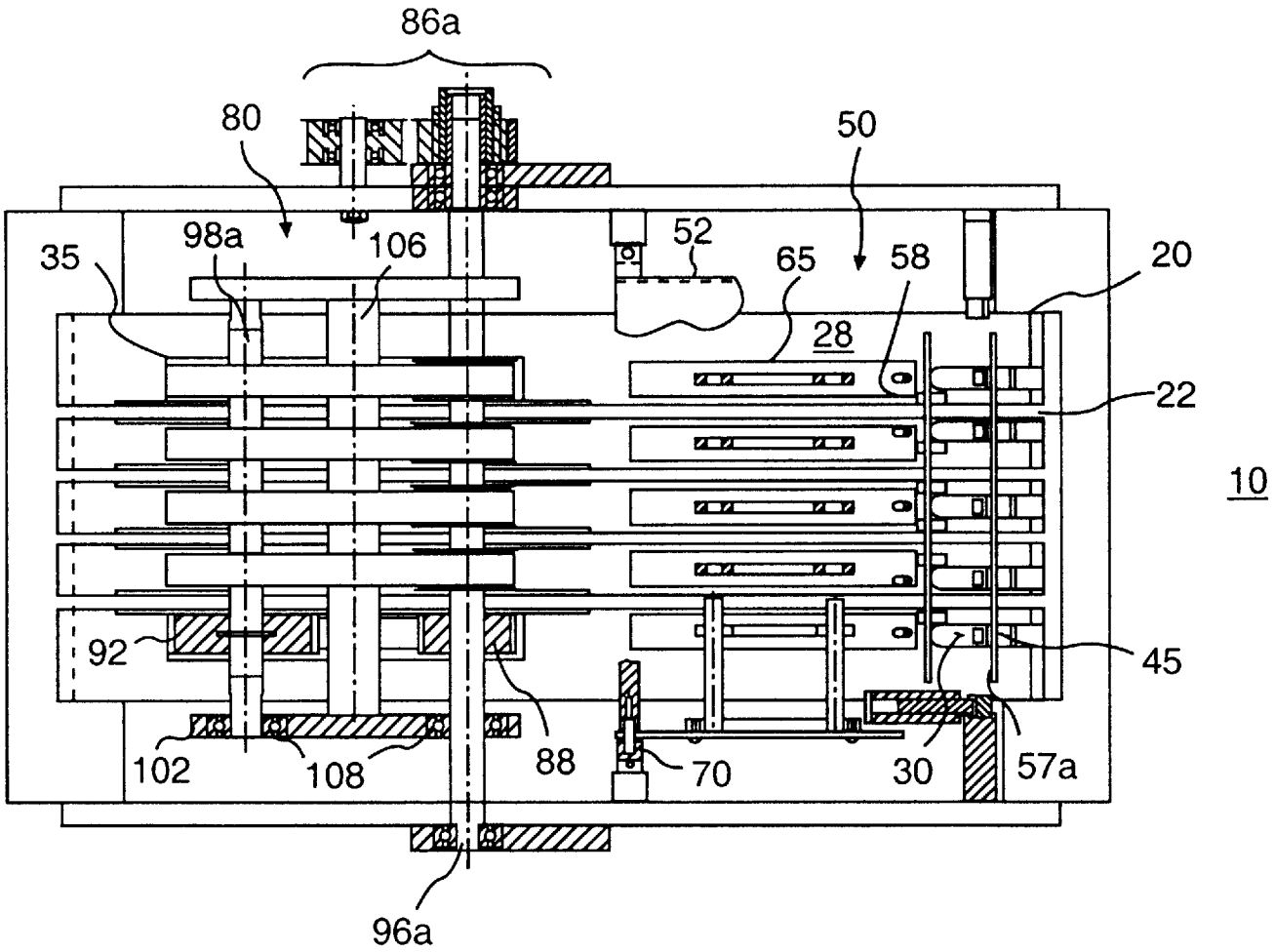
FIG. 14 is a top view of the present invention.

FIG. 14 illustrates a top view of the present invention 10. Transport 20 can be seen having slots 22 therein. As can further be seen, recessed portions 30 are provided in top surface 28 of transport 20. Finger stops 45 are mounted in recess portions 30. Further notches 35 are provided in transport 20 to receive the plurality of rollers 90 and 94 and belts 100 of the lower pressing unit portion of pressing unit 80. Lift finger mounting pin 57*a* can be seen as well as a mounting bar for the stationary fingers 58. Retaining strips 65 are shown leading from the half folding mechanism 50 towards the pressing unit 80. A cut away portion of cover 52 can be seen as well as pivot hinge 70. Rollers 88 mounted to drive shaft 95*a* and rollers 92 mounted to idler shaft 98*a* are illustrated as being connected via belts 100 and being mounted in upper shaft mount arms 102. Upper shaft mount arms 102 are shown mounted rigidly apart via a spacer bar 106. Shafts 96*a* and 98*a* are seen suitably mounted for rotation via bearings 108. Gears 86*a* of gear box 86 are shown to impart rotation of the drive shafts in any suitable manner.

It is to be understood that the embodiments herein described are merely illustrative of the principles of the present invention. Various modifications may be made by those skilled in the art without departing from the spirit or scope of the claims which follow.

What is claimed is:

1. An apparatus for folding sheet material having a leading edge and a trailing edge; said apparatus comprising:

means for conveying said sheet material through said apparatus;

means for folding said sheet material such that said leading edge is positioned over said trailing edge, said means for folding being operable solely by contact with and force applied from said sheet material being conveyed through said apparatus;

said means for folding comprising a plurality of lifting fingers pivotally mounted above said means for conveying to lift said leading edge;

said means for folding further comprising a plurality of stationary fingers mounted above said means for conveying to freely support said leading edge;

said plurality of lifting fingers cooperate with said plurality of stationary fingers to support said leading edge of said sheet material until said means for conveying contacts and removes said leading edge from said plurality of stationary fingers, said trailing edge of said sheet material becoming aligned with said leading edge; and means positioned adjacent said means for folding for pressing said folded sheet, said means for conveying propels said sheet material through said means for folding and through said means for pressing.

2. The apparatus of claim 1, wherein said means for conveying includes a plurality of pusher elements equally spaced apart at a distance.

3. The apparatus of claim 2, wherein said sheet material defines a width, and said apparatus is capable of folding universally sized sheet material having a width at least equal to said distance of said equally spaced apart pusher elements.

4. The apparatus of claim 2, wherein said plurality of pusher elements number at least three.

5. The apparatus of claim 2, wherein said plurality of pusher elements number four.

6. The apparatus of claim 1, wherein said means for folding includes a plurality of stripper elements, said apparatus selectively folding said sheet material around an insert material, said plurality of stripper elements preventing said insert material from being folded by said means for folding.

7. An apparatus for folding universally sized sheet material, defining a length and a width and having a leading edge and a trailing edge, in half lengthwise, said apparatus comprising:

a transport mechanism for conveying said sheet material through said apparatus;

a half-folding mechanism mounted above said transport mechanism for folding said sheet material in half, said half-folding mechanism including a plurality of lifting fingers biased toward said transport mechanism, and a plurality of stationary fingers, said half-folding mechanism operable solely by force applied from said sheet material;

said transport mechanism propels and forces said leading edge of said sheet material into said plurality of lifting fingers, said plurality of lifting fingers lift said leading edge to said stationary fingers as the propelled and forced sheet material forcibly pivots said plurality of lifting fingers against said bias and away from said transport mechanism;

the pivoted plurality of lifting fingers cooperate with said plurality of stationary fingers to hold said leading edge until said transport mechanism contacts said leading edge and removes said leading edge from said stationary fingers, said trailing edge being conveyed into alignment with and under said leading edge; and a presser unit mounted adjacent said half-folding mechanism for pressing and creasing the folded sheet material.

8. The apparatus of claim 7, wherein said plurality of lifting fingers are pivotably mounted and spring biased toward said transport mechanism.

9. The apparatus of claim 7, wherein said plurality of lifting fingers and said plurality of stationary fingers are L-shaped.

10. The apparatus of claim 7, wherein said half-folding mechanism is pivotally mounted, at an end thereof, said half-folding mechanism rotatably positionable about said pivot mount away from said transport mechanism.

11. A method of half-folding a sheet material having a leading edge and a trailing edge, said method comprising the steps of:

providing a sheet transport;

providing a half-fold mechanism having a plurality of lifting fingers mounted above said transport and a plurality of stationary fingers mounted above said transport, said lifting fingers being spring biased toward said transport;

imparting a force to said sheet material to propel said sheet material along said transport;

propelling said leading edge of said sheet material into said plurality of lifting fingers;

pivoting said plurality of lifting fingers via said force imparted to said sheet material;

lifting said leading edge of said sheet material with said plurality of lifting fingers as said plurality of lifting fingers are pivoted;

rolling said leading edge over upon said plurality of stationary fingers by continued propulsion of said sheet material along said transport; and freely supporting said leading edge on said plurality of stationary fingers via cooperation with said plurality of lifting fingers until said trailing edge is aligned with said leading edge.

12. An apparatus for half-folding a sheet material, having a leading edge and a trailing edge, being propelled along a transport, said apparatus comprising:

at least one lifting finger positioned along and pivotably mounted above said transport and having a paper engaging end, said at least one lift finger pivotable by a force exerted thereagainst by said sheet material;

at least one stationary finger mounted above said transport approximate said at least one lifting finger;

at least one stripper element mounted proximate said at least one stationary finger; and said sheet material being folded in half via contact with said at least one lifting finger in cooperation with said at least one stationary finger and said at least one stripper element, wherein said at least one lifting finger cooperates with said at least one stationary finger to freely support the leading edge of the sheet material until the trailing edge of the sheet material is aligned with the leading edge.

13. The apparatus of claim 12, wherein said at least one lifting finger is pivotably mounted, said paper engaging end engages and lifts said sheet material as said at least one lifting finger is pivoted by a force applied from the propelled sheet material.

14. The apparatus of claim 13, wherein said at least one lifting finger curls said leading edge of said sheet material over and onto said at least one stationary finger and freely and temporarily supports said leading edge of said sheet material thereon.

15. An apparatus for folding sheet material having a leading edge and a trailing edge being propelled across a transport by at least one pusher element, said apparatus comprising:

at least one lifting element pivotably mounted above said transport; and at least one support element mounted above said transport proximate said at least one lifting element;

said at least one lifting element engages said leading edge of said sheet material as said sheet material is propelled along said transport, said at least one lifting element pivots from the force of the propelled sheet material to lift said leading edge, said at least one lifting element curls said leading edge over and onto said at least one support element as said at least one lifting element is pivoted, said at least one support element freely supports said leading edge via cooperation with said at least one lifting element until said trailing edge is aligned with said leading edge and said at least one pusher element contacts said leading edge and removes said leading edge from said at least one support element.

16. The apparatus of claim 15, wherein said at least one support element includes a stripper portion, said stripper portion preventing any insert material on said sheet material from being lifted by said at least one lifting element.

* * * * *